United States Patent [19]

Smith

[11] 4,103,671

[45] Aug. 1, 1978

[54] WINDOW OVEN DOOR FOR SELF-CLEANING OVEN

[75] Inventor: David G. Smith, Weston, Canada

[73] Assignee: GSW Limited - GSW Limitee, Toronto, Canada

[21] Appl. No.: 756,119

[22] Filed: Jan. 3, 1977

[51] Int. Cl.[2] ..... F23M 7/00

[52] U.S. Cl. ..... 126/200; 126/190; 126/197; 49/65

[58] Field of Search ..... 126/197, 198, 200, 190; 49/65

[56] References Cited

U.S. PATENT DOCUMENTS

| | | | |
|---|---|---|---|
| 3,500,815 | 3/1970 | DeWeese et al. | 126/200 |
| 3,507,267 | 4/1970 | Lafforgue | 126/200 |
| 3,881,462 | 5/1975 | Barnett | 126/200 |
| 4,022,183 | 5/1977 | Martin | 126/200 |

*Primary Examiner*—John J. Camby
*Assistant Examiner*—Larry I. Schwartz

[57] ABSTRACT

An oven door has a movable shield for covering its window during a self-cleaning cycle of an oven. The door includes apparatus for automatically raising and lowering the shield to and from a window covering position as the oven door is raised and lowered, improved track system for controlling and guiding the shield movement within the door and improved locking means for locking the oven door shut only when the shield is in its window covering position.

20 Claims, 15 Drawing Figures

WINDOW OVEN DOOR FOR SELF-CLEANING OVEN

FIELD OF THE INVENTION

This invention relates to an oven door for use with an oven which is capable of being operated at high temperatures for purposes of pyrolytic cleaning of the oven, commonly known as a self-cleaning oven. In particular, the oven door includes improvements in apparatus for raising and lowering a shield within the door, a track system to which the shield is connected for movement within the door, and a locking mechanism for locking the oven door shut on an oven.

BACKGROUND OF THE INVENTION

A self-cleaning cycle is often employed in a domestic stove or oven to clean the interior surfaces of the oven. In a customary manner, the oven interior is raised to a sufficiently high temperature to cause thermal decomposition of grease, grime, and other material in the oven. The temperatures achieved in the oven during the self-cleaning cycle may reach or surpass those which cause pyrolysis of the grease and grime. It is desirable for safety reasons to cover and protect or shield the one or more transparent panes in the window of an oven door from thermal radiation generated in an oven operating at high temperatures. Various types of systems are used to raise and lower a shield to cover the one or more window panes mounted on the outer panel of the oven door, to guide the movement of the shield within the oven door, and to lock the oven door shut during the operation of the oven at higher temperatures. Some systems involve the manual grasping of lugs exterior of the inner panel of the oven door to provide for manual raising and lowering of the shield. Other systems involve raising the shield to the window covering position as the oven door is being locked shut. This usually entails a complex linkage mechanism which amplifies the relative short distance of travel or rotational movement of the locking mechanism to cause the shield to move a much greater distance to cover the window. The shield may be mounted on or connected to a track system which supports the shield on both sides. This type of shield mounting can result in jamming due to thermal expansion and contraction of the metal in the shield and track system. In systems which involve simultaneous raising of the shield and locking the oven door shut, should there be a malfunction in the mechanism for raising the shield, the oven would be activated for self-cleaning without shielding of the door window panes.

It is therefore an object of the invention to provide an apparatus which automatically raises and lowers the shield in an oven door to and from a window covering position, as the oven door is respectively raised from and lowered to an oven door open position.

It is another object of the invention to provide an improved track system for suspending or mounting the shield within the oven door in a cantilever manner so that the unsupported end of the shield is free to move in accommodating thermal expansion within the shield.

It is yet another object of the invention to provide guidance means on the free end of the shield as it is mounted in a cantilever manner, to insure that the shield does not interfere with parts internally of the oven door as the shield is raised and lowered.

It is a further object of the invention to provide an improved locking means to lock the oven door shut when it is operating at high temperatures, the locking means being activated only when the shield is in the window covering position.

SUMMARY OF THE INVENTION

According to this invention, an oven door is provided with a drive means which is adapted for movement within the door relative to the door's height. The movement of the drive means is associated with the hinged movement of the door where the movement of the drive means is translated via the apparatus of this invention into raising the shield to cover the window as the oven door is raised. The improved locking mechanism has a pivotal catch means which is released to allow the locking mechanism to be moved to lock the oven door shut only when the window is in the window covering position. To insure a jam-free smooth movement of the shield within the oven door as it is raised, the shield is suspended at one side on an improved linear motion bearing means which positions the shield to move to and from a window covering position. The other end of the shield is free to move in a lateral direction to accommodate thermal expansion in the shield.

According to an aspect of the invention, the oven door has spaced apart outer and inner panels with aligned window openings and one or more transparent panes. The oven door is mounted on an oven by a hinge assembly at each side of the oven door. This enables the door to be raised from and lowered to an oven door open position. Locking means is provided for locking the oven door shut on an oven when it is desired to clean the oven and when the shield is raised to a window covering position. An apparatus for raising and lowering the shield to shield the transparent pane in the outer door panel, is caused to be raised by the movement of the drive means. A track system positions the shield between the outer and inner door panels for movement to and from a window covering position.

The apparatus for raising and lowering the shield has an actuator arm pivotally mounted within the door and connected in some manner to the shield. A fastener means or latch means connects or engages the actuator arm with the drive means to transfer the motion of the drive means to said actuator arm. The actuator arm is in a position which places the shield in a window uncovered position with the fastener means connected and the door at its open position. The shield remains in a window uncovering position when the fastener means is unconnected as the oven door is raised and lowered. The arrangement of the apparatus is such that, as the door is raised from its open position with the fastener means connected, the movement of the drive means causes the actuator arm to be swung upwardly relative to the door's height to automatically raise the shield to its window covering position.

The oven door may be mounted on an oven frame by a hinge assembly having a main hinge arm mounted in the oven frame and a secondary hinge are mounted in the oven door. A third arm may be provided on the hinge assembly where according to another aspect of the invention, the third arm is mounted in such a manner that it moves within the door along the length of the secondary hinge arm as the door is raised and lowered. With this particular aspect of the invention, the third arm constitutes the drive means to provide the necessary movement which is translated into raising and lowering the shield.

The linear motion bearing means of the track system is an improvement on the track system disclosed in U.S. Pat. No. 4,022,183. A first end portion of the shield is mounted on or connected to the linear motion bearing means so that when the door is in the up or closed position, the shield is suspended within the door in a cantilever manner. The linear motion bearing means includes a stationary rod mounted in or on the oven door to one side of the window. The first end portion of the shield is connected to the rod means by a connector means which is adapted to slide along the length of the rod. Such connector means may be integrally formed with the shield.

The track system may include a guidance system for the free end or second end portion of the shield to ensure that this end does not get caught on or interfere with other parts in the oven door. The guidance system does not support the second end portion of the shield when the oven is in an upright position so that the second end is free to move and thereby accommodate thermal expansion in the shield. The guidance system includes at least one roller means mounted on the second end portion of the shield and opposing guide surfaces between which the roller means is positioned so that as the shield is moved, it is maintained spaced apart from both the inner and outer panels.

The locking means in the oven door for locking the oven door shut comprises a rotatable locking arm which engages a cooperating portion on an oven frame. The locking means is located above the window in the oven door and includes pivotal catch means for preventing movement in the locking arm. When the shield is raised to cover the window, the upper portion of the shield engages the catch means to pivot it away from engagement with the locking arm to thereby permit movement of the locking arm. With this arrangement, the locking means cannot be activated unless the latch is engaging the actuator arm with the drive means of the apparatus. The latch can be moved to engage the actuator arm with the drive means only when the oven door is open. There is therefore nothing external of the oven door which can function to activate the oven self-cleaning cycle until the shield is in the raised position. This combination results in a system which ensures that the shield is in a window covering position before the oven can be put into a self-cleaning cycle.

DESCRIPTION OF THE DRAWINGS

These and other objects, advantages and features of the invention will become apparent in the following detailed description of preferred embodiments of the invention which are shown in the drawings, wherein.

DETAILED DESCRIPTION OF THE PREFERRED EMBODIMENTS OF THE INVENTION

Figure 1:
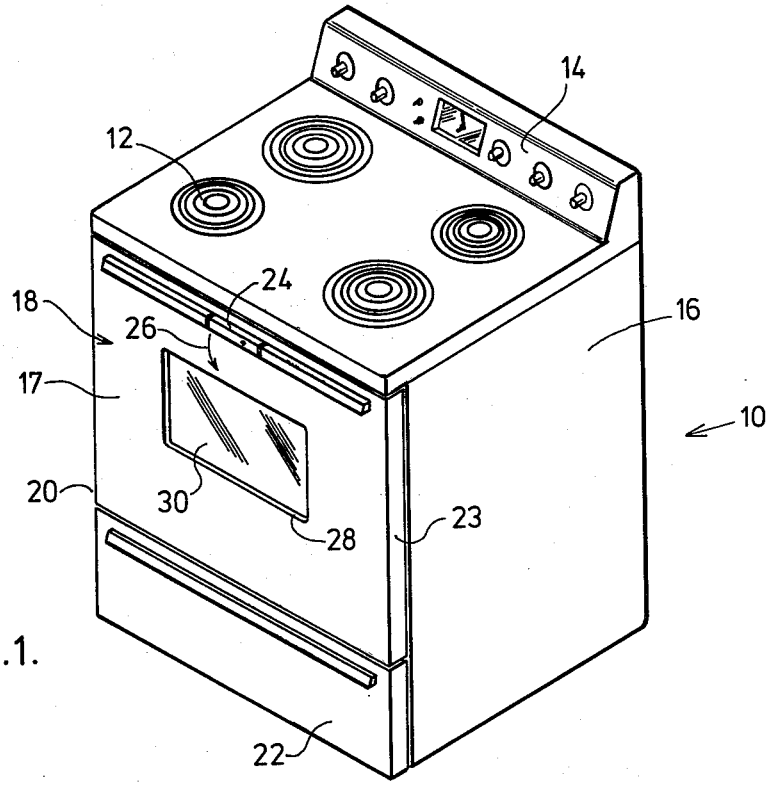
FIG. 1 is an isometric view of a stove or range having a self-cleaning cycle for cleaning its oven.

The familiar type of range 10 is shown in FIG. 1. The range has burner elements 12, control panel 14, and frame or shell 16 which houses the oven cavity. On the front of the range there is the oven door 18 which swings downwardly about its lower portion 20 to an open position to allow entry to the oven cavity. Beneath the oven door is the conventional pot and pan storage drawer 22. On the exterior of the upper portion of the oven door 18 is a rectangular knob 24 which can be rotated in the direction of arrow 26 to lock the oven door shut when the range is in the self-cleaning cycle. The details of the locking mechanism will be discussed hereafter in more detail. The oven door 18 has a window opening or aperture 28 to permit viewing into the oven cavity. The window is usually provided with one or more window panes 30.

Figure 2:
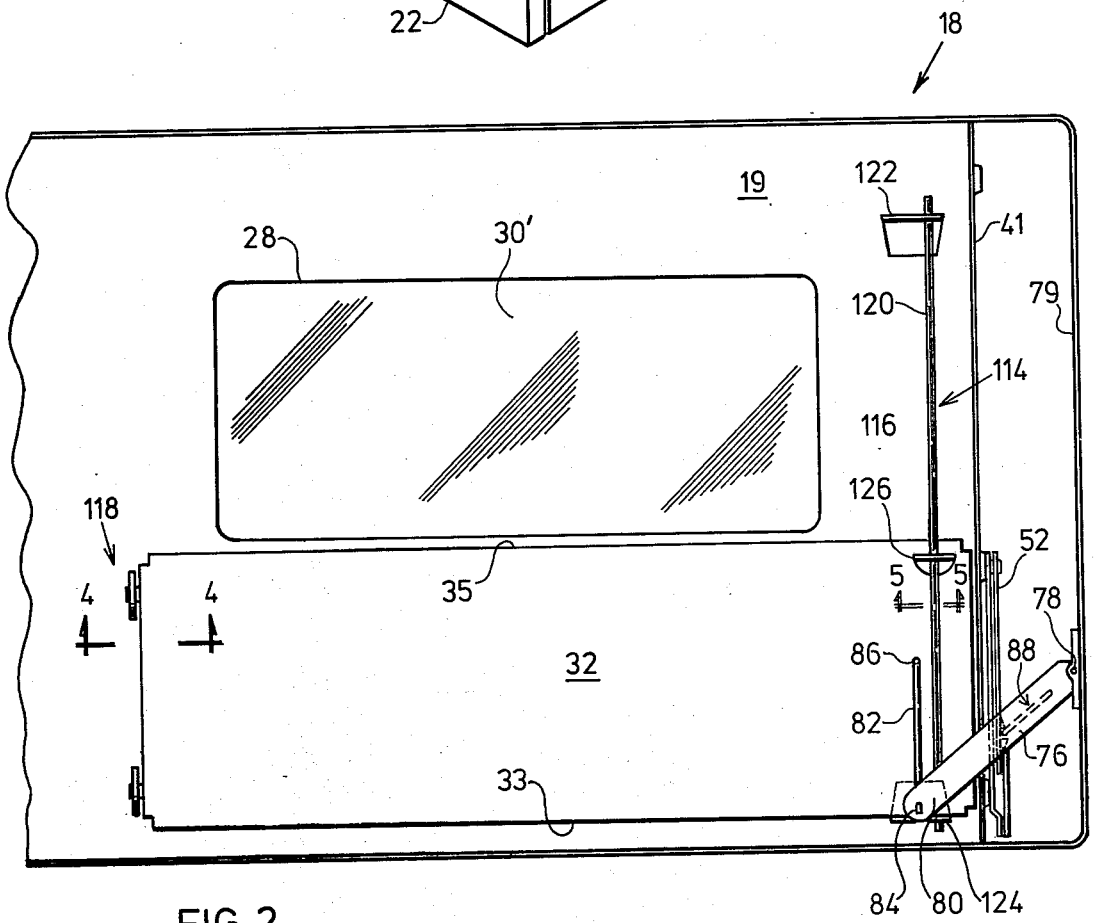
FIG. 2 is a view of the oven door having the outer panel removed to show the inside of the inner panel with the shield mounted thereon.
Figure 3:
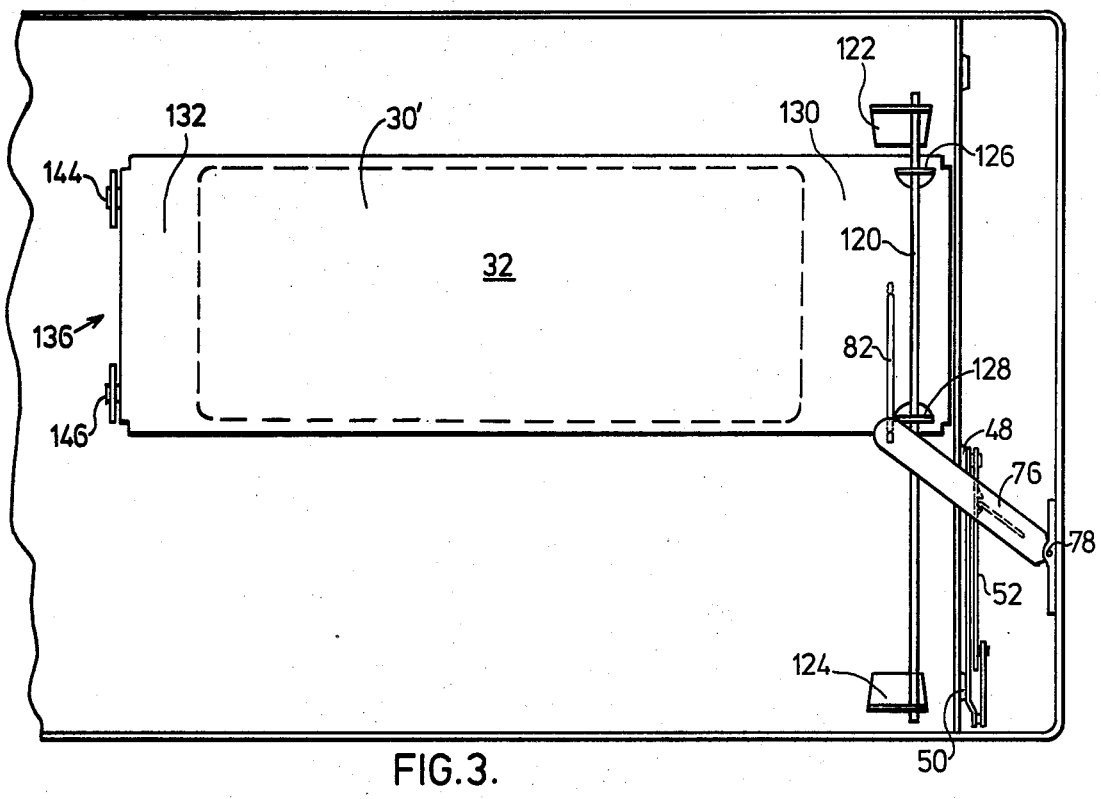
FIG. 3 is oven door of FIG. 2 in a vertical position with the shield in the raised position covering the window.

FIGS. 2 and 3 show the interior surface of the inner panel 19 of the oven door to clearly illustrate the manner in which the shield 32 is mounted within the oven door. In FIG. 2 the shield 32 is in the lowermost position within the oven door 18, leaving window pane 30' uncovered. The inner panel 19 may have a portion which projects from the inner panel, such portion being commonly referred to as the oven door plug. One or more panes 30' may be mounted in the oven door plug and spaced apart from pane 30' is pane 30 which is mounted in the aperture of the outer door panel 17. FIG. 3 shows the shield 32 in the raised position covering window pane 30'. The shield is positioned within the door in such a manner that it is between panes 30 and 30' when raised. The shield 32 when raised blocks the view into the oven and shields window pane 30 from thermal radiation generated by the oven operating at sufficiently high temperatures to cause pyrolysis.

Figure 7:
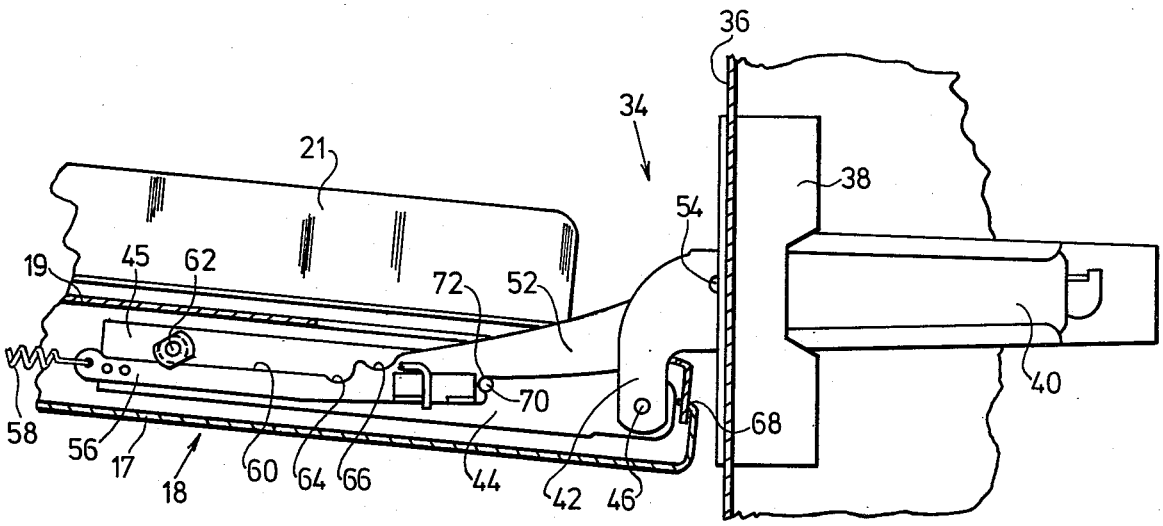
FIGS. 7, 8, and 9 show various positions of the drive means in the door as the oven door is raised from its open position.
Figure 8:
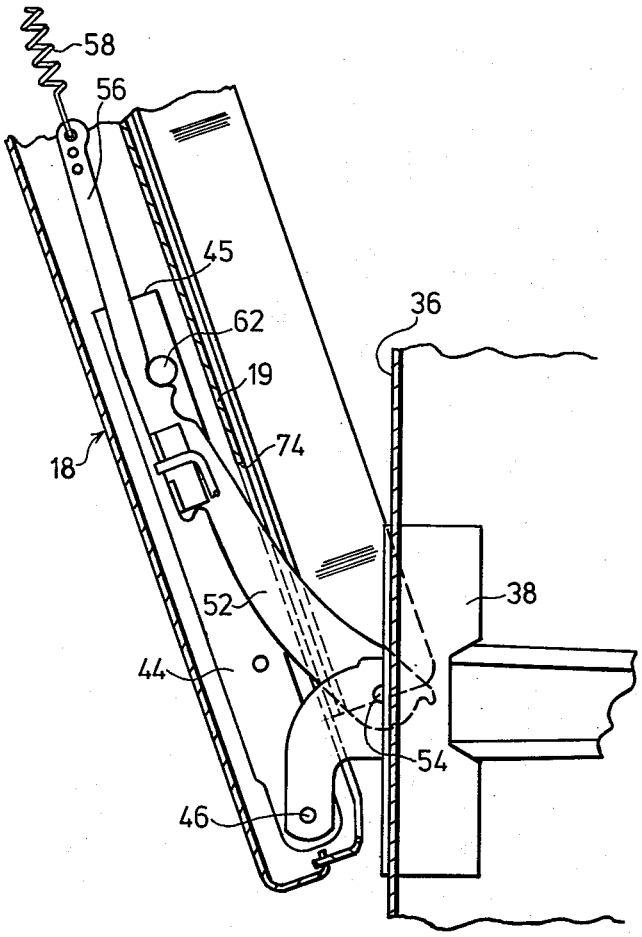
Figure 9:
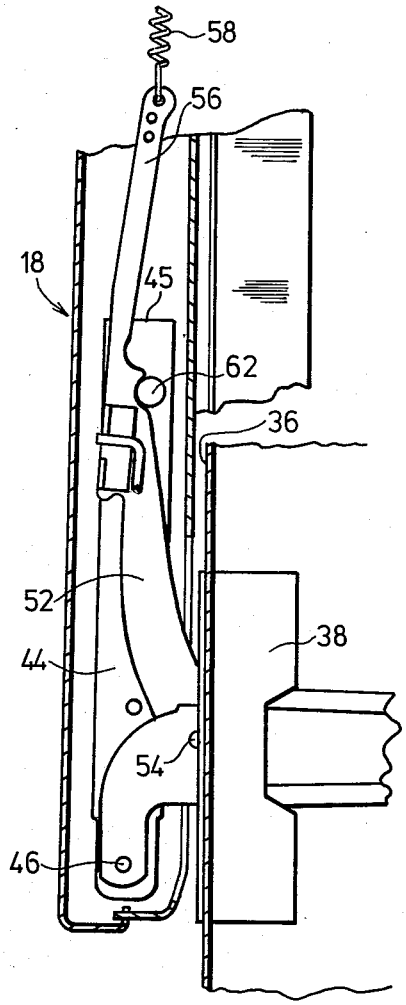

The oven door 18 is mounted on the frame 16 by the hinge assembly 34 shown in FIG. 7, 8 and 9. A hinge assembly is provided adjacent each side of the oven door at the lower portion 20 thereof. Secured to the front panel 36 of the oven frame 16 is a bracket 38 which receives the main hinge arm 40. A free end 42 of the main hinge arm projects exteriorly of the oven frame 36. A secondary hinge arm 44 is pivotally connected at 46 to the free end 42. The secondary hinge arm 44 is secured to a plate 41 at each side of the oven door at points 48 and 50 as shown on the right hand side in FIG. 3. The oven door, therefore, swings about the horizontal axis defined by pivot points 46 on the hinge assemblies 34. A third component or arm 52 is provided on the hinge assembly. The arm 52 is pivotally connected to the main hinge arm 40 at 54. This point of pivot is above and inwardly of pivot point 46 of the hinge assembly. The free end 56 of the arm 52 has a tension spring 58 secured thereto. The tension spring is secured internally of the oven door to always maintain tension on the arm 52. The arm 52 is commonly referred to as a control arm because with the geometry of this arrangement, the inner surface 60 of the control arm 52 rides against cam portion or roller 62 which is mounted on secondary hinge arm 44. Recesses 64 and 66 define the "broil" and "closed" positions of the oven door as shown in FIGS. 8 and 9 as these recesses interact with the cam portion 62. A pin 70 is secured to the secondary hinge arm 44 to interact with recess 72 of the arm 52 to function as stop and thereby define the lowermost "open" position of the oven door.

The inner panel 19 of the oven door has a longitudinally extending slot 74 cut therein, as shown in FIG. 8, to accommodate the movement of the control arm 52 within the oven door. The slot 74 is of sufficient width to accommodate the hinge assembly main and control arms when the door is closed. The weight of the oven door during its being lowered and raised is counterbalanced by the control arm because the control arm exerts an upward force on cam portion 62 commensurate with the tension in spring 58, the upward force increasing the further the door is lowered because the spring is extended further. Such an arrangement assists in lowering and raising the oven door and also defines "open", "broil" and "closed" positions for the oven door.

The aforementioned plug portion of the inner door panel is shown at 21 in FIG. 7. The plug portion 21 has one or more window panes 30' for purposes of insulating the oven door to reduce its external temperature and retain heat energy within the oven cavity. Insulation material may be spaced around the various components between the outer and inner door panels 17 and 18. The outer door panel 17 may include an inturned lip 23, as shown in FIG. 1 which is secured to correspondingly in-turned lip on the inner door panel 19. To facilitate assembly of the outer panel 17 and the inner panel 19 a hinge relationship at the base of the door may be formed by projection 68 of the outer panel interacting with a corresponding recess on the inner panel 19 in the manner shown in FIG. 7.

The free end 56 of the arm 52 is shown in FIG. 7 as being approximately at the same position as the outer end 45 of the secondary hinge arm. As the oven door is raised to the "broil" position shown in FIG. 8, the arm 52 moves upwardly along the door's height to the position shown in FIG. 8. Free end 56 of the arm 52 is now above end portion 45 of the secondary arm. This is due to the arm 52 being pivoted about a point 54 which is inwardly of the pivot point 46 of the door. As the door is moved to the closed position as shown in FIG. 9, the free end 56 of the arm 52 has been raised even further relative to end 45 of the secondary hinge arm.

With this particular embodiment of the invention, the drive means is the control arm 52. The upward movement of the control arm 52 within the oven door 18 is translated by the apparatus of this invention into automatically raising the shield 32 as the door is raised. As shown in FIG. 2 the apparatus includes an actuator arm 76 which has an end thereof pivotally connected at 78 to the inturned lip 79 of the inner panel 19. The actuator arm is positioned to cross the control arm 52. The position of the actuator arm relative to the control arm is an underlying relationship when the door is in the open position. The actuator arm has a second end 80 connected to the shield 32 by link arm 82 which is pivotally connected to the actuator arm at 84 and to the shield at 86. It is important to note that the link arm 82 is connected to the shield 32 at a point offset from the side of the window 28 so that the connection is not visible to the operator when the shield is raised. Provided on the actuator arm 76 is a latch or fastener arrangement 88, as shown in shadow, for engaging or connecting the arm 76 with the control arm 52 at a point between the ends of the arm 76.

Figure 10:
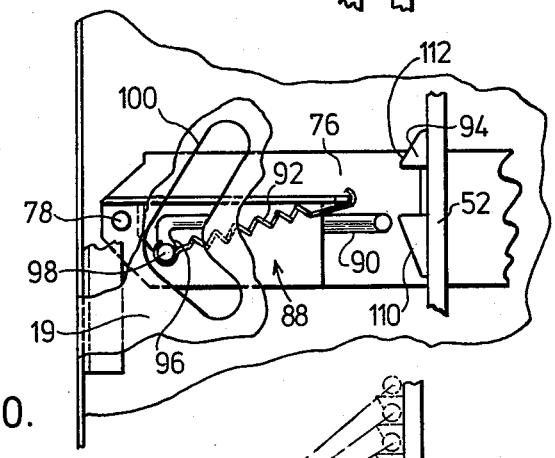
FIG. 10 shows the latch means of the actuator arm disengaged from the drive means and the shape of the aperture on the inner panel of the oven door.

Turning to FIG. 10, the latch arrangement 88 includes a moveable finger 90, spring 92, catch portion 96 and a clip or finger receiving portion 94 on control arm 52. The spring 92 is arranged to bias movement or travel of the latch finger 90 in a direction towards clip 92. The catch portion 96 engages leg portion 98 of the finger 90 in the manner shown to retain the finger 90 out of engagement with the clip 94. The leg portion 98, to which the spring 92 is attached, projects exteriorly of the inner panel 19 through boomerang-shaped aperture 100 in the inner panel 19.

Figure 6:
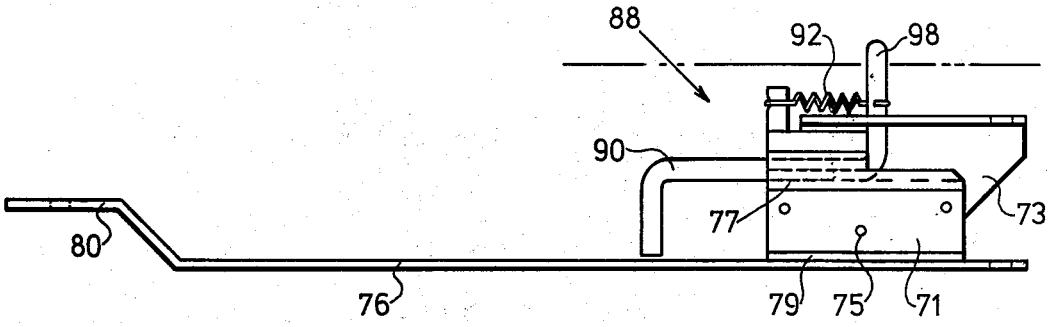
FIG. 6 is a side view of the latch on the actuator arm of the apparatus according to this invention.

FIG. 6 shows the manner in which the latch arrangement is mounted on the actuator arm 76. Two plates 71 and 73 are spot welded together at 75 and are joined at their base 79 to the actuator arm. The plates are so formed to provide therebetween a channel 77 through which the latch finger 90 is free to travel into and out of engagement with the clip 94 on the control arm 52.

Figure 11:
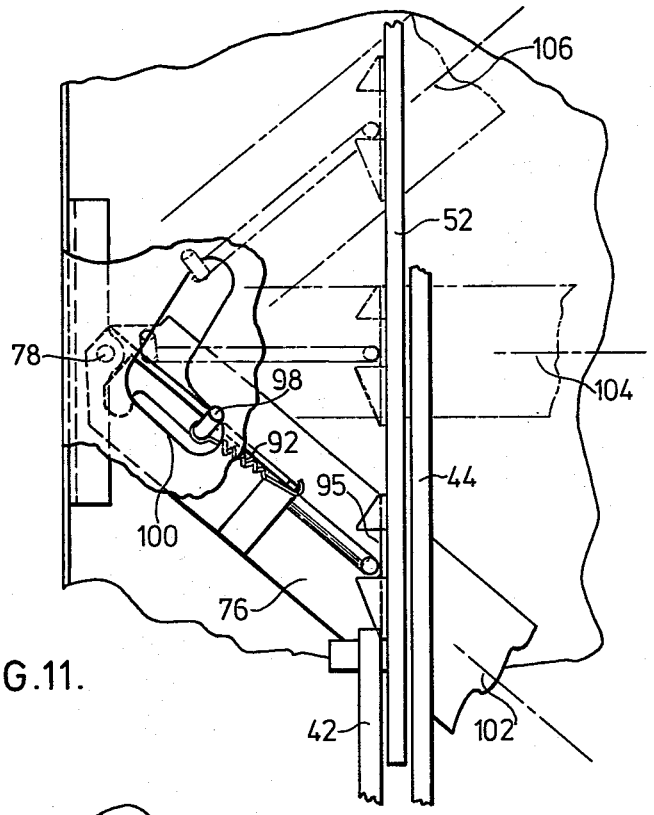
FIG. 11 shows the three positions of the actuator arm with the latch means engaged with the drive means.
Figure 12:
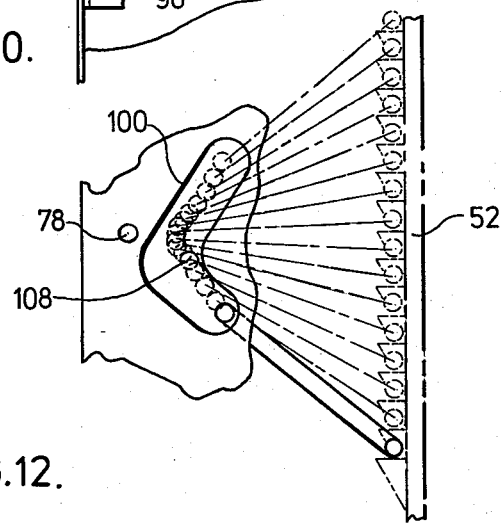
FIG. 12 shows the locus through which the latch leg travels as the oven door is raised.

As shown in FIG. 11 the leg portion 98 of the finger 90 was released manually from catch 96 while the door is in the open position. The finger 90 as mounted in channel 77 can be rotated about its length dimension to enable one to release leg portion 98 from catch 96. The spring 92 biases the finger 90 to travel and engage recess 95 of clip 94. The control arm 52 moves upwardly along the door's height during raising of the door so that the actuator arm 76 is swung upwardly about pivot point 78 through the positions designated 102, 104, and 106 in FIG. 11. This upward swinging of the actuator arm 76 is transferred by link arm 82 to shield 32 to raise it to the window covering position shown in FIG. 3. It is understood that the length of the actuator arm 76 and the link arm 82 have an effect on the positioning of the shield, therefore the lengths of the arms must be calculated to properly position the shield in both its window uncovering position and window covering positions. As the actuator arm 76 pivots about point 78, the latch finger 90 will move or travel inwardly and outwardly along the locus of points 108 as shown in FIG. 12. The aperture 100 is shaped to accommodate this inward and outward movement of the finger leg 98. Such movement of the finger 90 is accommodated by the spring 92. This ensures that the spring loaded finger 90 remains engaged with clip 94 and that there is no jamming of the finger 90 as the control arm moves within the door.

To actuate the apparatus for raising the shield, the latch is usually engaged by a manual manipulation when the door is fully open. The arrangement is such that with the door in the fully open position the finger will move into recess 95 of the clip. However, if the finger 90 is disengaged from the catch when the oven door is in a partially raised position, the clip 94 will have moved away from latch 88. For this reason, inclined surfaces 110 and 112 are provided on each side of clip 94 so as to cammingly engage the released finger 90 to insure a smooth entry of the extended finger into clip recess 95 as the door is lowered to the fully open position. This insures a trouble-free operation of the latch.

The shield is maintained in the raised position by the engagement of latch 88 with the control arm 52. When the door is closed, the latch leg 98 is inaccessible so that during the self-cleaning cycle, the shield remains in the window covering position. During normal operation of the oven, the latch is maintained in the disengaged position by catch 96 so that the shield remains beneath the window 28 to permit clear viewing into the oven when the oven door is raised. The lower portion of the shield 33 may rest at the base of the oven door in the manner shown in FIG. 2. The weight of the shield insures that it remains beneath the window 28 as the oven door is raised and lowered so that the shield never slides into view during normal operation of the oven.

Although the arm 52, as shown in FIG. 7, is mounted in a manner to move upwardly within the door as it is raised, it is understood that the arm can be pivoted about a point which is beneath the pivot point of the main and secondary hinge arms so that the arm moves downwardly within the door as it is raised. This latter arrangement may not effect the desired counterbalance to the weight of the door, however, it will induce the desired movement in the drive means. For that matter, in order to provide the necessary motion of a component within the door, it may be economically feasible to mount an arm on the hinge assembly in a manner which only functions to move within the door to provide the motion which is translated into raising the shield. It is understood that the arrangement of the actuator arm relative to the drive arm would be changed to translate a downward movement of the hinge arm into raising the shield. This may be accomplished by pivoting the actuator arm at a point intermediate its ends and arranging the latch to engage the first end of the actuator arm which is remote from the end connected to shield, to the third hinge arm. The downward movement of the third hinge arm would, therefore, swing the end of the actuator arm connected to the shield in an upward direction. It is also understood that the drive means can take on other forms within the oven door, such as, spring movements and the like.

The apparatus in the oven door according to this invention, therefore, provides a means for automatically raising the shield to cover the window as the door is raised. There is no need to grasp lugs or the like on the interior surface of the oven door to raise manually the shield.

According to another aspect of the oven door of this invention, a track system 114 which includes a linear motion bearing means generally designated 116 and a guidance means generally designated 118 is provided to control and guide the movement of shield 32. The linear motion bearing means comprises a rod portion 120 mounted on the inner panel 19 by standards 122 and 124. The rod is positioned between the inner surface of panel 19 and the rod 120 in the manner shown in FIG. 5. Integrally formed on the shield 32 are upstanding spaced apart tabs 126 and 128 which are used in connecting the shield to the rod. The tabs 126 and 128 have apertures formed therein of a size which permits the rod 120 to pass therethrough, yet, retain the shield 32 in a roughly horizontal position when the door is in a vertical position as shown in FIG. 3. The tabs are spaced sufficiently far apart to ensure a smooth sliding of them along the rod. As can be appreciated, if the tabs were too close together, the shield would jam and become cocked. Therefore, in the most preferred situation the tabs are formed adjacent the upper and lower edges 35 and 33 of the shield.

It is apparent that the shield 32, when the door is in a vertical position, is mounted in a cantilever manner where the first end portion 130 of the shield is connected to the rod 120 and the second end portion 132 is suspended within the oven door. This arrangement for mounting the shield 32 within the oven door permits the shield 32 to expand without buckling during operation of the oven at high temperatures because the second end portion 132 is free from support and can move in a lateral and vertical direction.

Figure 4:
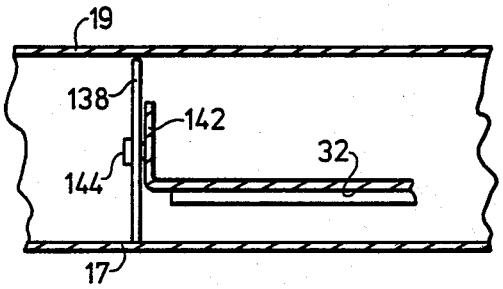
FIG. 4 is a section along lines 4—4 in FIG. 2.
Figure 5:
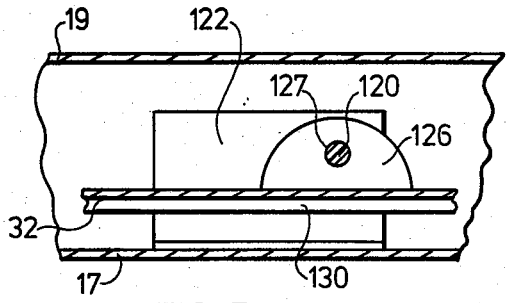
FIG. 5 is a section along lines 5—5 in FIG. 2.

Although the shield 32 can move upwardly and downwardly within the door without interfering with any other components within the oven door, in some instances a guidance system is necessary to insure that the free end of shield 32 remains spaced from both inner and outer panels in the oven door. As shown in FIG. 5, the first end portion 130 of the shield is spaced apart from the inner and outer door panels by the position of rod 120. The guidance system provided for the free end 132 is generally designated at 136. The guidance system comprises two roller elements 138 and 140 which in this preferred embodiment are in the form of discs attached to upturned edge 142 of the shield 32. The discs rotate about axes 144 and 146. As shown in FIG. 4, the diameter of disc 138 is slightly less than the distance between opposing guidance surfaces which, in this instance, are the inner surfaces of door panels 17 and 19 to provide the necessary clearance for free rotatable movement. This ensures that the shield 32 is always spaced apart from the inner and outer door panels 17 and 19. As the shield is raised and lowered, the disc 138 may contact either guide surface and due to the clearance, the disc is free to rotate in either direction as required in maintaining the shield 32 spaced apart from both the inner and outer door panels 17 and 19 and free of interfering with other components within the door.

It is understood that arrangement of this type of guidance system may be used on any type of shield arrangement where the shield is suspended within the oven door in a cantilever manner.

Figure 15:
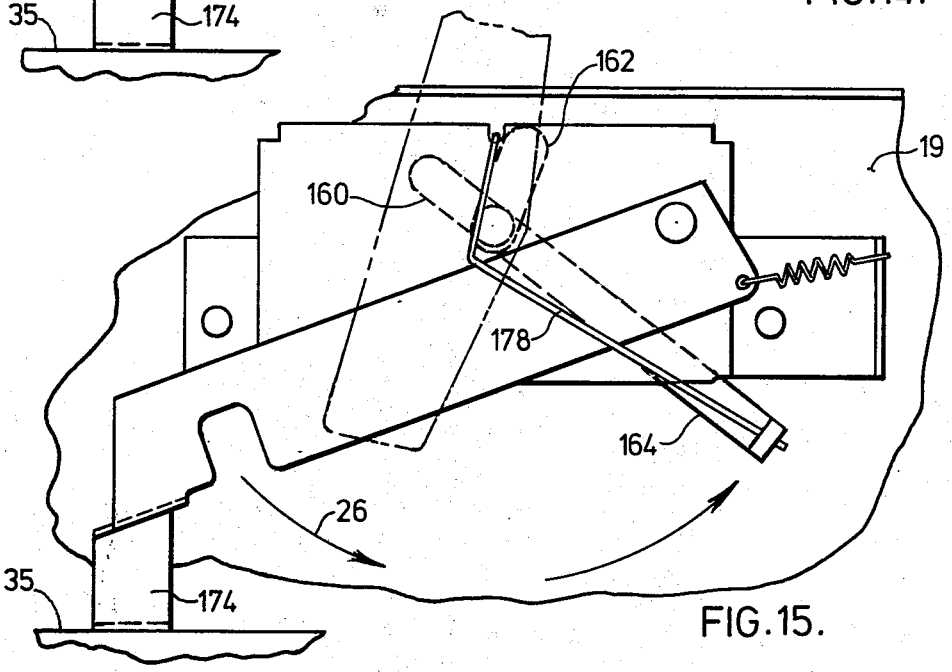
FIG. 15 is a view of the locking means with the locking arm rotated to lock the door shut.

It is important to lock the oven door shut when the range 10 is put into the self-cleaning cycle. This prevents contemplated or accidental opening of the oven door to protect people from being exposed to the extremely high temperatures within the self-cleaning oven. The lock mechanism generally designated 150 in FIG. 13, has control knob 24 attached thereto. It can be moved to the lock position shown in FIG. 15 to lock the door shut. The lock mechanism 150 comprises a locking arm 152, having an axle portion 154 mounted to rotate in the lock frame 156. The lock frame is attached to the inner door panel 19 by rivets 158. The locking arm 152 includes a first leg portion 160 which projects exteriorly of the inner panel 19 and fits within a recess 162 of the oven frame, as shown in shadow in FIGS. 13 and 15. The locking arm 152 includes a second leg portion 164 which is between the panel 19 and the lock frame 156.

Figure 13:
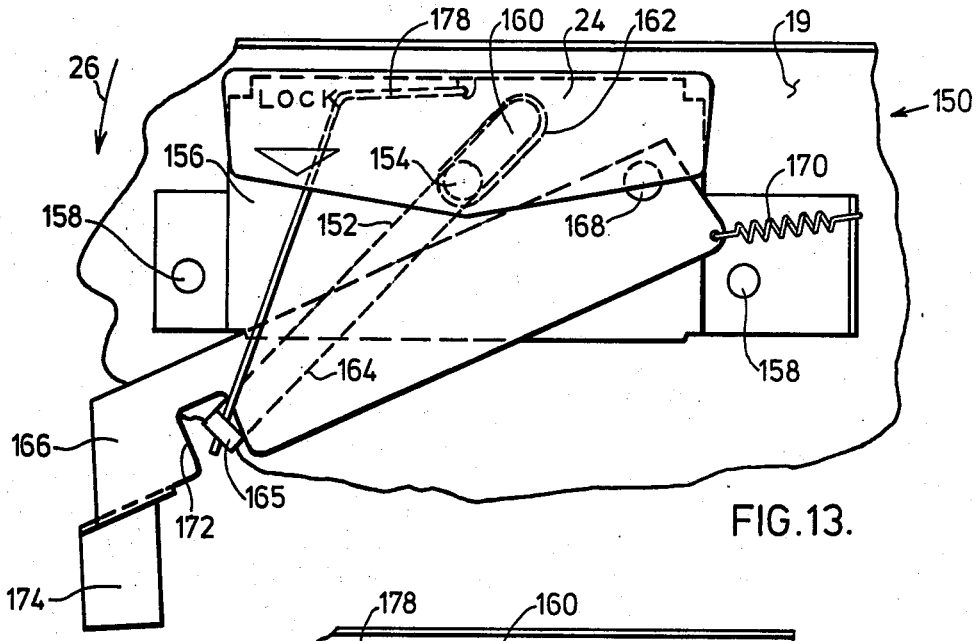
FIG. 13 is a view of the locking means mounted on the oven door inner panel.
Figure 14:
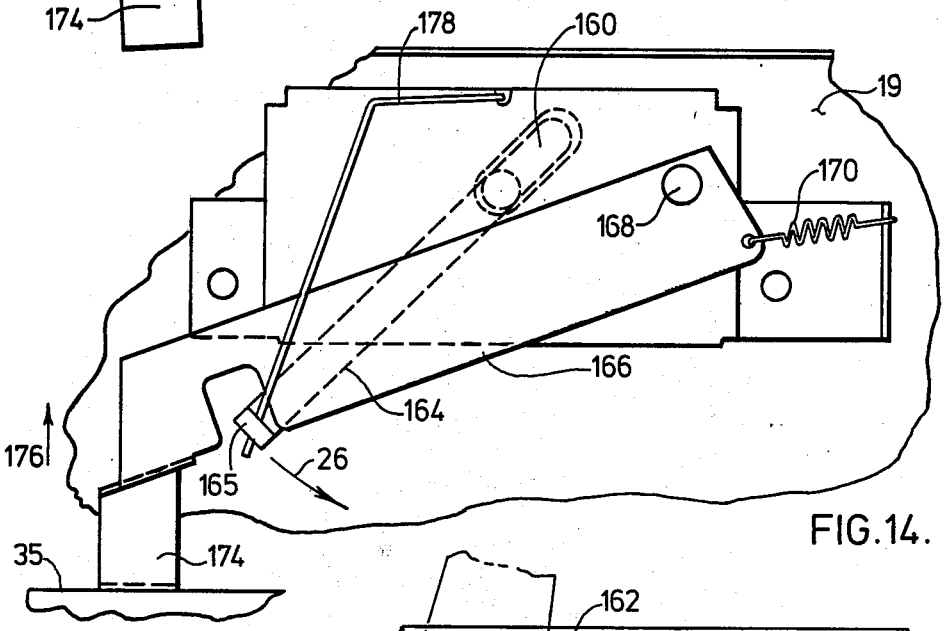
FIG. 14 is a view of the locking means with the shield in the raised position with the catch means pivoted upwardly out of engagement with the locking arm.

The locking mechanism 150 includes a catch means which engages or catches the second leg portion 164 to prevent movement of the locking arm 152. The catch means 166 is an elongated plate pivotally mounted to the locking means frame at 168. A spring 170 under tension causes the catch means 166 to pivot about point 168 in a downward direction. The catch means is provided with a recess 172 which engages or catches free end 165 of the lock arm 152 to prevent it from rotating in the direction of arrow 126. The position of the catch means 166, as shown in FIG. 13, is that which it assumes when the shield 32 is in the lowered position. When the shield 32 is raised to that of FIG. 3, the upper portion 35 of the shield contacts depending leg portion 174 of the catch means. As shown in FIG. 14, the catch means is pivoted upwardly in the direction of arrow 176 against the tension of spring 170 a sufficient distance to allow the free end 165 to rotate in the direction of arrow 26 and clear the recess 172. The locking arm 152 is rotated by movement of lock knob 24 in the direction of arrow 26 to the position shown in FIG. 15 where leg 160 of the locking arm is engaged behind the frame of the oven to secure oven door shut. As soon as the oven reaches a predetermined temperature, approximately 500° F or thereabouts, a stop is activated within the range to prevent the lock from being turned in a clockwise direction to unlock the door. To ensure that the lock mechanism moves positively to the locking position, an overcenter spring arrangement including spring 178 is provided.

After the self-cleaning cycle has been completed and the oven has cooled down, the stop on the lock is deactivated to allow the knob 24 to be rotated in a direction opposite to that of arrow 26 to move the locking arm 22 to the unlocked position. The overcenter spring 178 retains the lock in the unlocked position. The shield 32 is still in the raised position with the catch means 166 in a position out of engagement with the lock arm. As soon as the shield is lowered, the catch 166 pivots downwardly to the position shown in FIG. 13 to catch the leg portion free end 165. This arrangement of the apparatus for raising and lowering the shield and for locking the oven door shut ensures that the shield cannot be lowered accidentally while the oven is operating at pyrolytic temperatures because the means for lowering the shield is inaccessible. The window pane 30 is, therefore, always shielded from thermal radiation during the self-cleaning cycle.

The locking mechanism 150 is relatively simple in structure so that there are very few parts to bind or seize due to thermal expansion in the mechanism while the oven is operated at higher temperatures for purposes of self-cleaning.

The oven door, according to this invention provides a very dependable system for raising and lowering of the shield, for locking of the oven door shut, for ensuring smooth movement of the shield and for accommodating thermal expansion in the shield. Although various preferred embodiments of this invention have been described herein in detail, it will be apparent to those skilled in the art that variations may be made thereto without departing from the spirit of the invention or the scope of the appended claims.

The embodiments of the invention in which an exclusive property or privilege is claimed are defined as follows:

1. In an oven door having spaced apart outer and inner panels with aligned window openings and one or more transparent window panes, an apparatus for raising and lowering a shield to and from a position which covers and shields such transparent window pane in said outer panel from thermal radiation generated by an oven operating at high temperatures, said oven door being mounted on an oven by a hinge assembly at each side of said door which enables said oven door to be raised from and lowered to an oven door open position, locking means for locking said oven door shut on an oven when said shield is raised to a window covering position, a drive means adapted for movement in said door relative to and along the door's height, the movement of said drive means being associated with the hinged movement of said door, a track system to which said shield is connected for movement to and from a window covering position, said apparatus comprising an actuator arm pivotally mounted within said door and connected to said shield, a fastener means for connecting said actuator arm with said drive means to transfer the movement of said drive means to said actuator arm, said actuator arm being in a position which places said shield in a window uncovered position with said fastener means connected and with said door in its open position, said shield remaining in a window uncovered position when said fastener means is unconnected as said oven door is raised and lowered, the arrangement being such that as said door is raised from its open position, with said fastener means connected, said actuator arm is swung upwardly relative to said door's height to raise said shield to its window covering position.

2. In an oven door of claim 1, said actuator arm being mounted within said door to cross and be clear of said drive means, said fastener means connecting said actuator arm with the drive means in a manner to swing actuator arm about its pivot.

3. In an oven door having spaced apart outer and inner panels with aligned window openings and one or more transparent window panes, an apparatus for raising and lowering a shield to and from a position which covers and shields such transparent window pane in said outer panel from thermal radiation generated by an oven operating at high temperatures, said oven door being mounted on an oven by a hinge assembly at each side of said door which enables said oven door to be raised from and lowered to an oven door open position, locking means for locking said oven door shut on an oven when said shield is raised to a window covering position, a drive means adapted for movement in said door relative to and along the door's height, the movement of said drive means being associated with the hinged movement of said door, a track system to which said shield is connected for movement to and from a window covering position, said apparatus comprising an actuator arm pivotally mounted within said door and connected to said shield, a latch means for engaging said actuator arm with said drive means to transfer the movement of said drive means to said actuator arm, said actuator arm being in a position which places said shield in a window uncovered position with said latch means engaged and with said door in its open position, said shield remaining in a window uncovered position when said latch means is disengaged as said oven door is raised and lowered, the arrangement being such that as said door is raised from its open position, with said latch means engaged said actuator arm is swung upwardly relative to said door's height to raise said shield to its window covering position.

4. In an oven door of claim 3, said latch means comprising a moveable spring loaded finger attached to said actuator arm, said drive means having recess means adapted for engagement with said spring loaded finger, said spring loaded finger being spring biased towards said recess means, catch means for retaining said finger out of engagement with said recess means, said finger being releasable from said catch means to allow said finger to move towards and engage said recess means.

5. In an oven door of claim 3, said drive means including a control arm connected to said hinge assembly in a manner to adapt said control arm to move upwardly along the door's height as said oven door is raised, said actuator arm being pivotally mounted in said door at one end thereof, the other end of said actuator arm being connected to said shield, said latch means engaging said actuator arm with said control arm at a point between the ends of said actuator arm so that upward movement of said control arm swings said actuator arm upwardly to thereby raise said shield.

6. In an oven door of claim 5, said actuator arm is connected to said shield by a link arm having one end pivotally connected to said shield and its other end pivotally connected to said actuator arm, the length of said link arm being such that when said actuator arm is in its fully up position, the shield covers said window.

7. In an oven door of claim 5, said hinge assembly comprises a main hinge arm mounted in an oven frame, said main hinge arm providing a free end extension of such oven frame, a secondary hinge arm mounted within said oven door at a respective side with its lower end pivotally connected to said free end of said main hinge arm so that said oven door swings about a horizontal axis, said control arm having an end pivotally connected to said main hinge arm at a point inwardly of such oven away from the point of pivot of said main and secondary hinge arms, the other end of said control arm positioned within said oven door between said inner and outer panels and having a tension spring attached thereto to place said control arm under tension and pivot towards and remain in contact with a cam portion mounted on said secondary hinge arm, said control arm moving upwardly along the height of said oven door as said oven door is raised.

8. In an oven door of claim 5, said latch means comprising a moveable spring loaded finger attached to said actuator arm, said control arm having clip means adapted for engagement with said spring loaded finger, said spring loaded finger being spring biased towards said clip means, catch means for holding said finger out of engagement with said clip means, said finger being releasable from said catch means to allow said finger to move into engagement with said clip means.

9. In an oven door of claim 8, said finger being moveable towards and away from said control arm as said actuator arm is swung within said door to maintain engagement of said finger with said clip means when it is desired to move said shield.

10. In an oven door of claim 8, said finger having an extension projecting through an aperture in and projecting exterior said inner panel of the oven door, said finger being released from said catch by manipulation of said extension, the shape of said aperture being such to accommodate movement of the finger extension as said latch is engaged with said clip means during movement of said drive means.

11. In an oven door having spaced apart outer and inner panels with aligned window openings and one or more transparent window panels, an apparatus for raising and lowering a shield to and from a position which covers and shields such transparent window pane in said outer panel from thermal radiation generated by an oven operating at high temperatures, said oven door being mounted on an oven by a hinge assembly which enables said oven door to be raised from and lowered to an oven door open position, locking means for locking said oven door shut on an oven when said shield is raised to a window covering position, a track system positioned within said door to which said shield is connected for movement between said outer and inner panels to and from a window covering position, said track system comprising a linear motion bearing means to which a first end portion of said shield is connected and guidance means for guiding movement of a second end portion of said shield, said linear motion bearing means having a stationary rod means mounted in said oven door and extending from beneath and along one side of said window, said first end portion of the shield being connected to said rod means by connector means which surrounds the perimeter of said rod means and which is adapted to slide along the length of said stationary rod means, the arrangement being such that said stationary rod means in combination with said connecter means positions and guides movement of said shield to and away from said window covering position, and the second end portion of said shield being free to accommodate thermal expansion in said shield.

12. In an oven door of claim 11, said connector means comprises two spaced apart plates having apertures which receive said rod means, said first end portion of said shield being connected to said plates.

13. In an oven door of claim 11, said connector means being integrally formed with said shield.

14. In an oven door of claim 13, said connector means comprises two spaced apart tabs integrally formed with said shield, each tab being perpendicular to the plane of said shield and having an aperture formed therein to receive said rod means, said tabs as mounted on said rod means supporting said shield within said oven door where each tab is formed adjacent the upper or lower edge of the shield.

15. In an oven door having spaced apart outer and inner panels with aligned window openings and one or more transparent window panes, an apparatus for raising and lowering a shield to and from a position which covers and shields such transparent window pane in said outer panel from thermal radiation generated by an oven operating at high temperatures, said oven door being mounted on an oven by a hinge assembly which enables said oven door to be raised from and lowered to an oven door open position, a track system positioned within said door to which said shield is connected for movement between said outer and inner panels to and from a window covering position, said track system suspending said shield within said oven door with a first end portion of said shield mounted on a linear motion bearing means to position and guide movement of said shield to and away from said window covering position, a guidance system being provided for said second end portion of said shield to guide its movement, said guide system comprising at least one roller means mounted on said second end portion and opposing guide surfaces between which said at least one roller means is positioned, said roller means being of a diameter to provide clearance between said guide surfaces so that said roller means is free to roll on either guide surface as said shield is moved, to thereby maintain said shield properly spaced apart from both said inner and outer door panels.

16. In an oven door of claim 15, said roller means rotating about an axis which is perpendicular to the direction of motion of said shield.

17. In an oven door of claim 16, said roller means being two discs spaced apart and mounted on said second end portion.

18. In an oven door having spaced apart outer and inner panels with aligned window openings and one or more transparent window panes, an apparatus for raising and lowering a shield to and from a position which covers and shields such transparent window pane in said outer panel from thermal radiation generated by an oven operating at high temperatures, said oven door being mounted on an oven by a hinge assembly which enables said oven door to be raised from and lowered to an oven door open position, locking means for locking said oven door shut on an oven when said shield is raised to a window covering position, a track system positioned within said door to which said shield is connected for movement between said inner and outer panels to and from said window covering position, said track system suspending said shield within said oven door with a first end portion of said shield mounted on a linear motion bearing means to position and guide movement of said shield to and away from said window covering position, said track system including guidance means mounted on a second end portion of said shield to guide its movement, said locking means being positioned above said window pane and comprising a rotatable locking arm which engages a cooperating portion on an oven frame to lock said door shut, pivotal catch means catching said locking arm to preclude its movement, said shield when moved to said window covering position contacting said catch means to pivot it upwardly away from engagement with said locking arm to thereby permit movement of said locking arm.

19. In an oven door of claim 18, said locking arm swinging through an arc which is below its pivot point as said locking arm locks said oven door, said catch means being pivoted at a point above said arc and engageable with said locking arm when in its unlocked position, said shield as it is raised to said window covering position pivoting said catch means upwardly to disengage it from said locking arm.

20. In an oven door of claim 19, said catch means including a notch which catches said locking arm.

* * * * *